US006766542B2

(12) United States Patent
Hinsperger

(10) Patent No.: US 6,766,542 B2
(45) Date of Patent: Jul. 27, 2004

(54) METHOD FOR AND PROTECTIVE WINTER COVERING FOR SWIMMING POOLS

(75) Inventor: Peter Hinsperger, Mississauga (CA)

(73) Assignee: Hinspergers Poly Industries Ltd., Mississauga (CA)

( * ) Notice: Subject to any disclaimer, the term of this patent is extended or adjusted under 35 U.S.C. 154(b) by 0 days.

(21) Appl. No.: 10/444,947

(22) Filed: May 27, 2003

(65) Prior Publication Data

US 2004/0117903 A1 Jun. 24, 2004

(51) Int. Cl.[7] ..... E04H 4/00
(52) U.S. Cl. ..... 4/498; 139/420 A
(58) Field of Search ..... 4/498, 503; 139/420 A

(56) References Cited

U.S. PATENT DOCUMENTS 2,870,455 A * 1/1959 Graham et al. ..... 4/498
3,593,757 A * 7/1971 Haynes ..... 4/498
5,887,296 A 3/1999 Handwerker ..... 4/498

FOREIGN PATENT DOCUMENTS

| | | |
|---|---|---|
| CA | 1174554 | 9/1984 |
| CA | 2161339 | 4/1994 |
| CA | 2262051 | 2/1999 |

* cited by examiner

*Primary Examiner*—Tuan N. Nguyen
(74) *Attorney, Agent, or Firm*—McFadden, Fincham

(57) ABSTRACT

A protective winter covering for swimming pools including an open mesh weave of scrim material, the mesh having warp and weft strips forming a substantially thin layer having opposed major surfaces, where both the warp and weft strip materials are of a heat absorbing material, and at least one of the major surfaces of the scrim material has a discontinuous coating having heat reflecting properties opposite to that of the warp and weft strip, the discontinuous coating theron at least partially covering the surface.

18 Claims, 2 Drawing Sheets

METHOD FOR AND PROTECTIVE WINTER COVERING FOR SWIMMING POOLS

FIELD OF THE INVENTION

The present invention relates to a method to protect and a protective cover for swimming pools.

BACKGROUND OF THE INVENTION

The present invention provides a development in the form of an improved protective cover for swimming pools, particularly as protective covers which find use as a winter protective cover for swimming pools.

In general terms, the average winter pool cover has various drawbacks that allow for such covers to permit debris or other unwanted foreign articles to pass into the pool, or that do not readily permit the passage (drainage) of the rain or melting snow that accumulated over the winter months into the swimming pool.

Many winter covers for swimming pools are composed of non-permeable generally flexible sheets of plastic material, with the cover either stretching across the opening of the swimming pool or lying on top of the pool water, in either case, the covers are anchored with weights or by tying means (ropes or other fastening devices) in which the ropes are fastened at one end to the pool cover and at the other end to an anchor or other fixed structure. Depending on the amount of precipitation, the conventional covers can be subjected to significant stress when the water or melting frozen precipitate accumulates on top of the cover, particularly at the end of a winter season. Depending on the amount of accumulated liquid, damage to the cover can occur particularly in the case where there is little or no water beneath the cover.

The requirements for swimming pool covers in terms of the material used for winter protection also requires that the material be able to stand up to the generally harsh winter elements, including the capability of being able to withstand thaw/freeze cycles, the weight of the accumulated snow on top of the cover, and the fact that debris (branches, leaves, large dirt particles etc.) can accumulate on the cover over the winter months, with a proviso that the cover not be subjected to tearing.

In the spring, it is desirable that such a cover to permit the accumulated snow to melt and drain into the pool, as opposed to trying to remove water located on the top of the pool cover. In addition, another desirable attribute would be where the cover would be able to absorb heat from the atmosphere and at the same time, reflect retained heat beneath the cover, which would allow not only for an increase in the melting of the snow but also would heat up water in the pool to further aid in the melting of snow. In addition, by permitting water to be filtered through the pool cover while providing the heating and retention properties, a cover would also desirably keep debris out of the pool during winter and during the melting of the snow.

A protective cover of this development, suitable for use in outdoor swimming pools, will thus ease the removal of debris from the cover surface after the spring melting of material on top of the cover; moreover, the cover will protect the pool liner by keeping such debris from passing through the cover.

More particularly, there is provided a protective swimming pool cover capable of absorbing light from the light spectrum in order to providing a heating effect and at the same time, the cover is provided with heat reflective properties on one side to retain heat in the pool.

SUMMARY OF THE INVENTION

According to one aspect of the present invention there is provided an improved heat absorbing winter protective covering material for swimming pools, comprising an open mesh weave of scrim material, the scrim material having warp and weft strips forming a thin layer with opposed major surfaces, wherein both the warp and weft strips are of a heat absorbing material; one of the major surfaces of the scrim material has a discontinuous coating thereon partially covering the surface; the coating being provided with heat reflecting material opposite to that of the warp and weft strips.

In a preferred embodiment of the present invention, the protective material is a continuous sheet of a one-piece "open" weave thermoplastic scrim material which may be provided with suitable stabilizing additives conventional in the industry as represented by ultraviolet stabilizers, extenders, anti-oxidants and the like.

Desirably, the scrim layer comprises an open-mesh weave of thermoplastic scrim material, the mesh comprising one or more substantially thin layers of intersecting strands of thermoplastic material forming a substantially closed formation when in a lay-flat condition having opposed major surfaces. Desirably, the mesh has a plurality of slits formed by intersecting strands of the open-mesh weave thereby permitting the passage of water there-through upon moisture or water pressure against the material.

The plastic material forming the strips of said composite can be made of any suitable material such as a polyolefin, the preferred polyolefin being a polyethylene or polypropylene (or a copolymer). The lace coating and the warp and weft strips can be each made of the same or a different polyolefin compatible with the polymer of the other components.

With respect to the above described field, the protective covering material includes both the warp and weft strips having heat absorptive properties, as it has been found that having both of the warp and weft strips with heat absorptive properties increases the amount of heat absorption of the product. Most preferably, the warp and weft strips form a substantially thin layer with opposed major surfaces.

Desirably, in a preferred embodiment, one of the major surfaces of the scrim has a discontinuous coating thereon, e.g. a lace coating which at least partially covers the surface, where the coating has heat reflecting properties opposite to that of the warp and weft strips.

The thickness of the scrim material used in the method of the present invention for the above field is not critical per se, as long as the product remains flexible and to the extent that water is generally able to permeate the surface through the slits or apertures; the thickness can be e.g. from 1 mil to e.g. 30 mils. or more if desired. The lace coating may likewise be relatively thin so that an overall lightweight covering can be obtained. For various types of applications, it may be desirable to provide a border surrounding the sheet material to provide an integral product.

Typically, preferred materials for the scrim layer and lace coating are thermoplastic in nature and by way of example such materials may be formed from a polyolefin such as polyethylene, polypropylene, copolymers, etc.

The coating component of the covering material of the present invention is of a discontinuous or intermittent nature, desirably in the form of a lace coating, and which forms an irregular pattern on one surface of the scrim layer. As will be described hereinafter, the lace coating can be in the form of irregular islands of coating with the islands being connected by strands or narrow strips of coating material. This coating tends to stabilize the warp and weft strips of the scrim layer and thus forms an integral product, particularly when the warp and weft strips of the scrim layer are not otherwise adhesively associated with one another. The lace coating may be formed from a heat reflective material or a material having a heat reflective component such as coloured material or reflective particles, strips etc. Desirably, the coating will cover between 5% to 80% of the scrim layer on one face thereof, most desirably 10% to 65% and preferably 15% to 50% of that surface. The coating may be applied to the scrim layer by suitable conventional techniques such as calendering, spraying, co-extrusion, or even adhesively bonded.

With respect to the heat absorbing function of either the lace coating or the warp or weft strips, such characteristics can be achieved by either selecting a thermoplastic material which has the capability of absorbing heat from the atmosphere (using selected additives in the material) or alternatively, by utilizing a colouring agent of a suitable characteristic which absorbs the energy emitted via the normal spectrum of light waves. Likewise, the other of the lace coating which is provided with reflective characteristics is produced, for example, by applying a colouring agent to the surface area from the normal light spectrum having heat specular properties such as white, silver, gold, bronze, etc., or from suitable material added thereto, for example reflective strips. Such a reflective quality of the scrim allows for heat to be reflected back toward the swimming pool or alternatively into the snow or ice built up on the cover over the winter months, helping increase the rate of melting of the accumulated snow or ice.

In another embodiment of the present invention, there is provided a method of forming a heat absorbing and heat reflective composite layer which comprises the steps of providing an open-mesh weave of scrim material in which the material has warp and weft strips forming a substantially thin layer and having opposed surfaces; wherein the warp and weft strip materials are of a heat absorbing material, and coating at least one of the surfaces of said scrim material with a coating to at least partially cover the surface, in which the coating has heat reflecting properties opposite to that of the warp and weft strips.

If desired, one or more reinforcing layers or threads may be included in the product structure where very thin covering products are used. Such a reinforcing layer or threads can strengthen the product as desired, particularly for large products covering large surfaces. For example, depending upon the desired use of the protective cover in the above noted field of the invention, such reinforcing layers can be in the form of additional reinforcing scrims incorporated into the material on one or both sides, desirably below the lace coating. Reinforcing techniques are known in various arts; they may be incorporated into the product on an in-line basis when the product is manufactured, or by extrusion, coating or like techniques. Any added reinforcing layer should not reduce the total slit availability of the material in such a manner as to close off substantially all of the slit apertures between adjacent strands; it may contribute to a reduced slit availability when this is desired to thereby provide different water permeability characteristics for different areas of the woven material.

As otherwise outlined herein, heat retention or heat absorption properties for the covering materials of the present invention, can also be varied by different means such as using concentrated or strong colours, or by including heat absorption additives in the warp/weft strips or lace coating. Thus, by way of example, reflective or absorptive particles could be included in the lace coating and/or the warp/weft strips to increase the properties desired. In addition, in the case of extruded polymeric materials for use in the lace coating, or the warp/weft strips, a co-extruded product could be employed to vary the amount of heat absorption/heat reflection characteristics of the product.

It will be obvious to those skilled in the relevant art that different degrees of heat absorption and heat radiation can be achieved for different purposes in the products of the present invention to permit products to be tailored for different applications and locations. One particular advantage of the present invention is that since only one lace coating is required, there is a savings in material, savings in the time required for producing the product, and costs are reduced.

Such a protective cover as described above finds advantageous use in both rural and urban areas where it is desirable to use the protective cover as a protective winter swimming pool cover. A protective cover utilized in such a manner is very desirable in areas where, for example, water is at a premium, and further helps reduce the cost of filling a pool with additional water in spring. Such a cover as contemplated by the present invention allows a more natural source of water to enter into the pool due to the porous mesh, while keeping large debris such as leaves, branches and other foreign particles out of the pool thereby helping protect the pool liner. Additionally, the cover of the present invention prevents light from entering the pool, which could cause algae to build up when the filtering system is not in operation, for example during the closing of the pool. Further, due to the water filtering into the pool from the cover, stagnant bodies or pools of water are reduced and therefore reduce areas for mosquitoes to thrive.

According to another preferred aspect of the present invention, there is provided a using of a protective cover having a structure generally described as a winter pool cover for a swimming pool wherein the protective cover is applied to the surface of water in a pool.

According to another aspect of the present invention, there is provided a method of forming a protective cover as a winter swimming pool as described above, as a protective winter pool cover comprising providing a protective cover, positioning the cover having a sufficient size over a corresponding swimming pool, and securing the protective cover through securement means over the surface of the pool to be covered.

In a further alternative embodiment, there is provided a heat reflecting, heat absorbing protective covering material for use as a winter protective swimming pool cover, comprising an open mesh weave of scrim material, the scrim material having warp and weft strips forming a thin layer with opposed major surfaces, where the warp or weft strips have heat absorbing properties, and one of the major surfaces of the scrim material has a discontinuous coating thereon partially covering the surface, the coating having heat reflecting properties opposite to that of the warp and weft strips.

In an alternative embodiment, the winter swimming pool protective cover includes a higher percentage of the lace coating, and desirably, a higher percentage of heat absorptive and heat reflective material in each respective element thereof as possible.

BRIEF DESCRIPTION OF THE DRAWINGS

Having thus generally described the present invention, reference will now be made to the accompanying drawings as follows.

DETAILED DESCRIPTION OF THE PREFERRED EMBODIMENTS

The product of the invention is particular suitable for protecting swimming pools from damage typically incurred after the pool structure has been closed or otherwise prepared for winter storage. As understood by those skilled in the art to which the present invention pertains, the term swimming pool as referred to herein, includes both above ground and in-ground pool structures.

Figure 1:
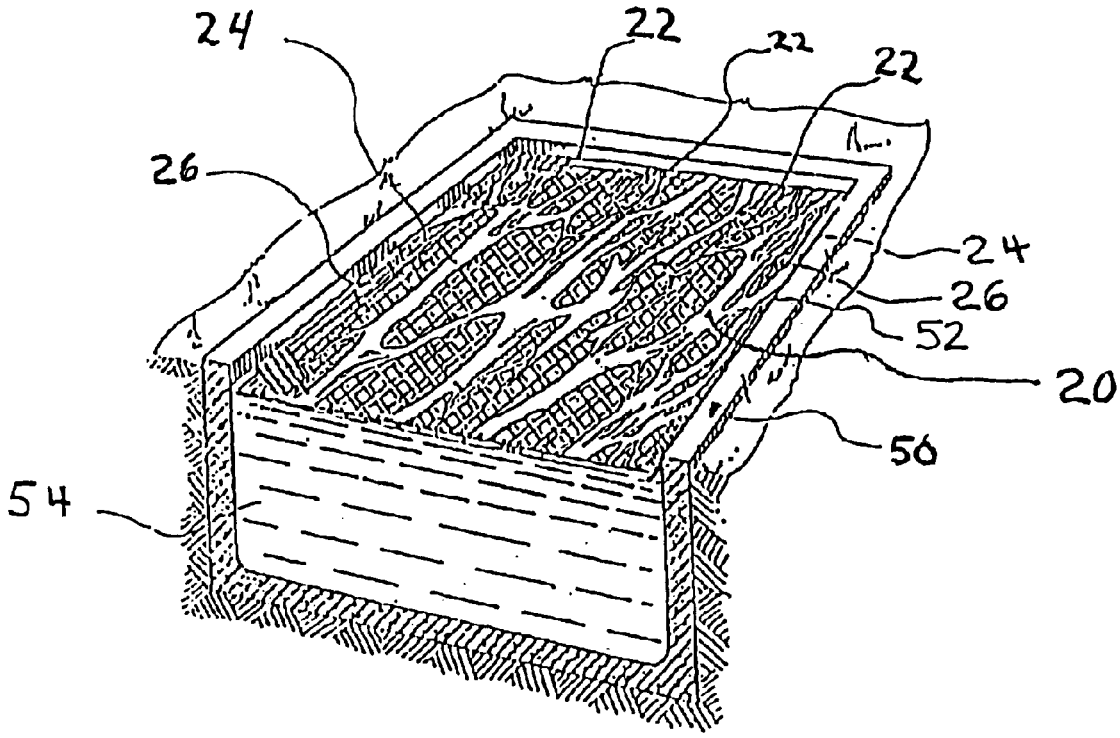
FIG. 1 is a vertical cross-section view of a typical swimming pool being provided with the protective cover and which illustrates one face of the product provided with a lace type coating over the scrim structure.
Figure 4:
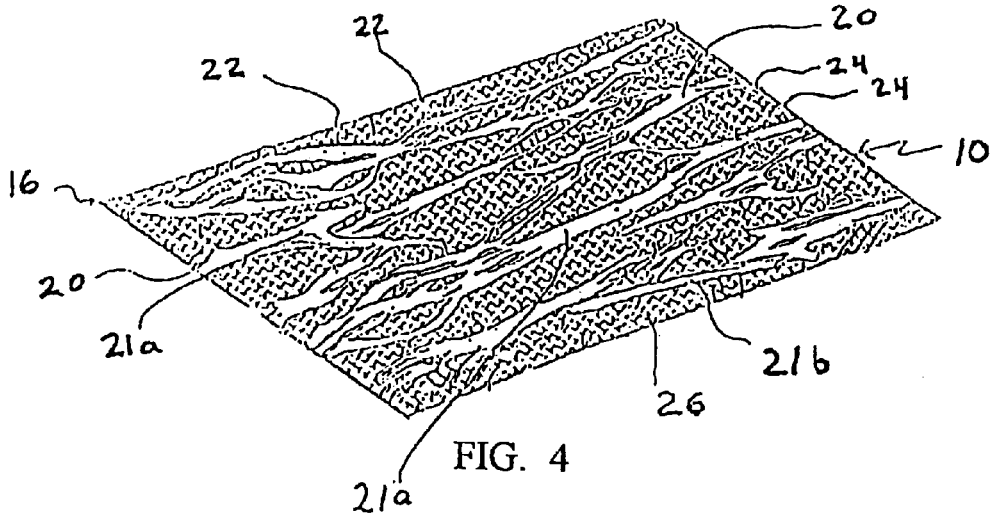
FIG. 4 is an elevated perspective view of a product of the present invention.
Figure 3:
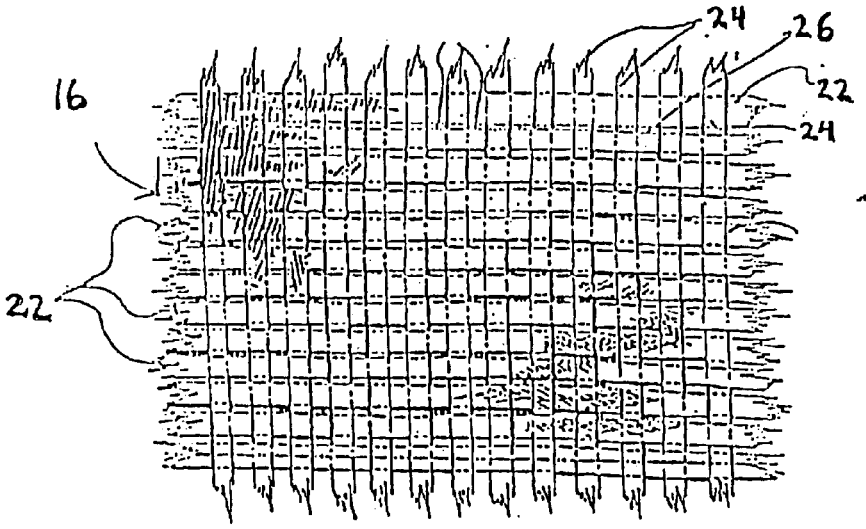
FIG. 3 is an enlarged bottom view showing the reverse side of the product of FIG. 1, which shows the scrim structure of warp and weft strips.

As illustrated in FIGS. 1, 3 and 4, the protective cover, generally indicated by reference numeral (10), includes upper and lower layers (12, 14), is well suited for use as a winter protective cover for pools. The interwoven weft and warp strips (22, 24) permit drainage of water, in the form of melted snow or ice, which has accumulated on top of the cover (10) over the winter to enter the pool via slits (26). Further, the protective cover (10) also retains debris, such as leaves, branches, etc. and prohibits such debris from passing into the pool, since the slits (26) formed in the cover (10) are not large enough to permit passage of such debris.

With reference to FIG. 1, the swimming pool protective cover (10), According to the present invention, includes upper and lower layers (12) and (14) forming a scrim layer generally indicated by reference numeral (16). The scrim layer (16) includes an outer lace coating (20) forming a heat reflective component of the product of the present invention and in which the lace coating (20) forms a top layer of the cover structure. Desirably, the lace coating (20) will constitute a relatively high percentage of the covering on one major face of the scrim layer (such as 40% to 60%). Preferably, reflective material or strips, such as silver coated strips or silver coloured strips, could be used to help increase the melting process.

As illustrated in FIG. 1, the protective winter cover (10) in use is positioned over a swimming pool structure generally indicated by the reference numeral (50). The protective winter cover (10) is positioned or maintained in place through suitable, conventional securement means (52) such that the cover (10) lays over the top or upper surface of the water (54). Such conventional means (52) may include ropes, tie downs, suitable pool clips, water bags or other suitable securing means known in the art.

Desirably, the cover (10) of the present invention includes high heat absorptive properties obtained by warp and weft strips having appropriate heat reflective/absorptive properties, which are determined by the amount of coating on or coloured properties of each of the warp and weft strips and the coating (20). Desirably, such coatings having heat absorption properties are preferably applied) to each strip, thereby providing for maximum heat absorption properties.

Further, as noted above, the lace coating (20) on the upper surface of the cover (10) may comprise heat absorptive qualities to assist in the absorption of heat. For illustrative purposes only, both the warp and weft strips (24, 26) include heat absorptive material on each strip, preferably at the higher end of the range noted above. This higher percentage of heat absorptive materials would allow for maximum heat absorption from the light permeating through the snow, and heat retention by the cover (10), thus allowing for increased melting of the accumulated snow and/or ice thereon, and reducing the pressure on the swimming pool walls and pool cover (10) itself, due in part to the reduced amount of water and ice thereon.

In a preferred embodiment, the heat absorbing material is a polyolefin polymer, incorporating a suitable colouring agent for absorption of heat. For example, colours such as green, blue, black and the like provide suitable heat absorption properties for the warp and weft strips, absorbing ultraviolet rays from the sun. Such materials may be used in the lace coating material.

Figure 2:
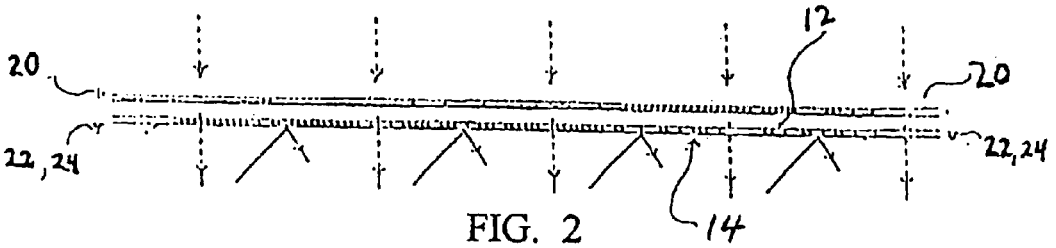
FIG. 2 is a diagrammatic cross-sectional view of the present invention.

FIG. 2 is a schematic representation of a cross-sectional view of a portion of a protective cover (10) of FIG. 1. As illustrated, the heat absorptive warp and weft strips (22) and (24) are provided with heat absorbing properties. Due to the relatively tight knit weave of the warp and weft strips forming the scrim material, even with slits (26), much of the heat absorbed from the light permeating through to the cover will be retained and transmitted to the pool and any snow or ice thereon.

Alternatively, the lower layer generally indicated by reference numeral (14) formed by warp and weft strips (22, 24) may be a similar polyolefin polymer, for example, polyethylene, and may be provided with a colouring agent having heat reflection properties. Thus, colours from the spectrum such as white, silver, gold, bronze, etc. could be used for the material on the bottom layer to provide sufficient reflection characteristics for the retention of heat.

FIG. 3 illustrates in schematic form the reverse face of the product of FIG. 1 and FIG. 4, and illustrates the structure of the warp and weft strips (22, 24) forming the scrim layer (16). For ease of reference and clarity, the lace coating (20) on the other surface of the product is not shown (the lace coating (20), of course, would otherwise cover some of the slits (26) between the warp and weft strips (22, 24) described herein).

In greater detail, as illustrated in this enlarged figure, there are provided a plurality of spaced-apart weft strips (22) and warp strips (24) which are interwoven to form the scrim layer (16). The intersecting warp and weft strips (22, 24) can be widely, or narrowly, spaced apart, if desired, to provide slits (26) in the scrim layer (16). The width of the slits (26) can be varied as to the degree of openness by controlling the tightness of the "weave" of the scrim layer. In the particular version shown, the slits (26) may constitute anywhere from 1% to 15% or so of the total surface area of that face of the scrim layer, so as to permit water to penetrate the product and provide moisture to the substrate layer. It will be appreciated that weft and warp strips (22) and (24) need not be spaced apart per se in order to permit water penetration. This is due to the fact that such warp and weft strips, even though generally retained in place by the lace coating, are not otherwise secured to each other and thus even slight moisture pressure can penetrate between intersecting warp and weft strips.

The individual weft and warp strips (22) and (24) can vary in width considerably, as noted previously. In the arrangement illustrated in FIG. 3, the warp and weft strips are generally of the same dimension(s) width-wise, but as noted previously, this can be varied to that one has a larger width than the other, depending on the ultimate heat absorptive properties desired in a product for any given application. Typically, the width of the warp and weft strips can range from about 1/18th of an inch to 1 inch or more. For most general applications, these strips will have a width in the range of from ¼ inch to ½ inch.

In the embodiment illustrated in FIG. 3 both the warp and weft strips are provided with heat absorptive components (e.g. by application of a suitable colouring agent included in the warp/weft strips) while the lace coating 20 (not shown) is provided with heat reflective properties. In this manner, the product as shown will include a heat reflective layer or properties in contact with the accumulated snow or ice on the upper portion of the cover (10) and will reflect radiated heat from the warp and weft strip into the accumulated snow or ice thereby providing accelerated melting of the snow and ice.

FIG. 4 is a perspective view of a protective cover (10) according to a preferred embodiment of the present invention, for use over a structure to be protected. As illustrated, cover (10) consists structurally of a scrim layer (16) with opposed major surfaces (12) and (14), and a discontinuous plastic polymer lace coating (20). As illustrated, lace coating (20) is located only on one surface (12) and preferably comprises a calendared polymeric material in the form of connected elongated "islands" **(21*a*) of coating material as seen in FIG. 4. Adjacent islands (21*a*) are interconnected by strands or small lengths of coating material (21*b*) in a random fashion. These islands (21*a*) will have varying widths and lengths but in general, the total surface area coverage of the lace coating in the embodiment illustrated is in the range of 15% to 20% of the surface on which it is located. Desirably, the overall cover is lightweight and flexible to allow for easy manipulation of the protective cover (10)** over a substrate structure.

The above embodiments are for illustrative purposes only, and as such various modifications are possible without departing from the scope and spirit of the invention.

I claim:

1. A heat reflecting, heat absorbing protective covering material for use as a winter protective swimming pool cover, comprising:

an open mesh weave of scrim material, said scrim material having warp and weft strips forming a thin layer with opposed major surfaces, said warp and weft strips having heat absorbing properties, and one of said major surfaces of said scrim material having a discontinuous coating thereon partially covering said surface, said coating having heat reflecting properties opposite to that of said warp and weft strips.

2. A heat reflecting, heat absorbing covering material according to claim 1, wherein said coating forms a lace coating on said one surface.

3. A heat reflecting, heat absorbing covering material according to claim 2, wherein said warp and weft strips are coloured to absorb light in a defined wavelength to provide heat absorbing properties thereto.

4. A heat reflecting, heat absorbing covering material according to claim 2, wherein said lace coating includes a colour with a light wavelength characteristic to provide heat reflecting properties.

5. A heat reflecting, heat absorbing covering material according to claim 1, wherein said warp and weft strips are of plastic material.

6. A heat reflecting, heat absorbing covering material according to claim 1, wherein said warp strips are made of a first polymeric material, and said weft strips are made of a second polymeric material different than that of said warp strips.

7. A heat reflecting, heat absorbing covering material according to claim 6, wherein said warp and weft strips are made of a polyolefin.

8. A heat reflecting, heat absorbing covering material according to claim 7, wherein said polyolefin is a polyethylene and said coating is a polyolefin compatible with said polyethylene.

9. A heat reflecting, heat absorbing covering material according to claim 8, wherein said coating includes a colouring agent providing heat absorption properties to said coating.

10. A heat reflecting, heat absorbing covering material according to claim 9, wherein said colouring agent of said warp and weft strips is green, blue, brown or black.

11. A heat reflecting, heat absorbing covering material according to claim 1, wherein said coating includes a colouring agent providing heat reflective properties to said coating.

12. A heat reflecting, heat absorbing covering material according to claim 11, wherein said colouring agent is silver, gold or bronze.

13. A heat reflecting, heat absorbing covering material according to claim 12, wherein said coating is secured to said surface.

14. A heat reflecting, heat absorbing covering material according to claim 1, wherein said open mesh weave includes openings to allow water to permeate therethrough.

15. A heat reflecting, heat absorbing covering material according to claim 1, wherein said coating on each surface of said open mesh weave amounts to a total of 5% to 80% of the combined total surface area of both faces.

16. Using a protective cover as claimed in claim 1, as a winter pool cover for a swimming pool, wherein said cover is applied to the surface of water in a pool.

17. A method of forming a protective cover as a winter swimming pool as claimed in claim 1, as a protective winter pool cover comprising (a) providing a protective cover;

(b) positioning said cover having a sufficient size over a corresponding pool, and (c) securing said protective cover over surface to be covered through securement means.

18. A method of forming a heat reflecting, heat absorbing protective covering material for use as a winter protective swimming pool cover, comprising the steps of:

providing a length of open mesh weave covering material, said mesh including warp and weft strips forming a thin layer with opposed major surfaces, wherein both of said warp and weft strips have heat absorbing properties;

and applying a discontinuous coating to one of said surfaces of said covering material whereby said coating at least partially covers said surface; said coating having heat reflecting properties opposite to said warp and weft strips.

* * * * *

UNITED STATES PATENT AND TRADEMARK OFFICE

CERTIFICATE OF CORRECTION

PATENT NO. : 6,766,542 B2
DATED : July 27, 2004
INVENTOR(S) : Peter Hinsperger

It is certified that error appears in the above-identified patent and that said Letters Patent is hereby corrected as shown below:

Tilte page,
Item [30], Foreign Application Priority Data, should read as follows:
-- [30] Foreign Application Priority Data,
December 23, 2002 …….2415044 --

Column 1,
Line 3, add "This application claims priority to Canadian patent application No. 2,415,044, filed December 32, 2002 --.

Signed and Sealed this

Twenty-fourth Day of May, 2005

JON W. DUDAS
*Director of the United States Patent and Trademark Office*